US007857006B2

(12) United States Patent
Baltes et al.

(10) Patent No.: US 7,857,006 B2
(45) Date of Patent: Dec. 28, 2010

(54) PRESSURE ACCUMULATOR, ESPECIALLY PULSATION DAMPER

(75) Inventors: Herbert Baltes, Losheim (DE); Markus Lehnert, Dillingen (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 1059 days.

(21) Appl. No.: 10/584,713

(22) PCT Filed: Jan. 18, 2005

(86) PCT No.: PCT/EP2005/000410

§ 371 (c)(1),
(2), (4) Date: Jun. 26, 2006

(87) PCT Pub. No.: WO2005/073564

PCT Pub. Date: Aug. 11, 2005

(65) Prior Publication Data

US 2009/0101222 A1 Apr. 23, 2009

(30) Foreign Application Priority Data

Jan. 29, 2004 (DE) ..... 10 2004 004 341

(51) Int. Cl.
*F16L 55/04* (2006.01)

(52) U.S. Cl. ..... 138/31; 138/30

(58) Field of Classification Search ..... 138/30, 138/31

See application file for complete search history.

(56) References Cited

U.S. PATENT DOCUMENTS 2,916,052 A * 12/1959 Peters ..... 138/30
3,467,140 A * 9/1969 Hanson ..... 138/31
3,862,646 A * 1/1975 Tarsha ..... 138/104
3,933,172 A * 1/1976 Allen ..... 137/494
4,685,491 A * 8/1987 Fulmer et al. ..... 138/31
4,717,494 A * 1/1988 Itatani et al. ..... 252/70
4,997,009 A * 3/1991 Niikura et al. ..... 138/30
5,031,664 A * 7/1991 Alaze ..... 138/31
5,205,326 A * 4/1993 Paley et al. ..... 138/30
5,353,840 A * 10/1994 Paley et al. ..... 138/31
5,624,105 A * 4/1997 Runkel ..... 267/64.15
5,771,936 A * 6/1998 Sasaki et al. ..... 138/31

(Continued)

FOREIGN PATENT DOCUMENTS

DE 199 08 089 9/2000

(Continued)

*Primary Examiner*—James F Hook
(74) *Attorney, Agent, or Firm*—Roylance, Abrams, Berdo & Goodman, LLP

(57) ABSTRACT

A pressure accumulator, especially a pulsation damper, includes an accumulator housing (10) and a piston element (28) disposed in it. A bellows-type separative element (30) is supported on the piston part (28) with its one end (32) and with its other end (34) on the accumulator housing (10). The separative element (30) separates two working chambers (26, 40) within the accumulator housing (10) from each other, especially a gas chamber (26) from a fluid chamber (40), in a fluid-tight, especially gas-tight manner. To one working chamber (26), in addition to a defined volumetric proportion of a working gas, is filled with a fluid. In this manner, the working gas allows for a compression to a certain degree and for a dampening and smoothening of the pulsations of the fluid medium migrating to and occurring on the fluid side of the accumulator.

11 Claims, 1 Drawing Sheet

U.S. PATENT DOCUMENTS

| | | | | |
|---|---|---|---|---|
| 6,810,915 | B2 * | 11/2004 | Umetsu et al. | 138/31 |
| 6,892,765 | B2 * | 5/2005 | Kamimura | 138/30 |
| 7,377,292 | B2 * | 5/2008 | Mori et al. | 138/30 |
| 2003/0000589 | A1 * | 1/2003 | Weber | 138/31 |
| 2005/0061379 | A1 * | 3/2005 | Mori et al. | 138/31 |

FOREIGN PATENT DOCUMENTS

| | | |
|---|---|---|
| DE | 100 09 865 | 9/2001 |
| DE | 102 53 012 | 11/2003 |
| EP | 1 384 899 | 1/2004 |
| JP | 60-143201 | 7/1985 |
| JP | 64-7901 | 1/1989 |
| JP | 2-67136 | 5/1990 |
| JP | 06-137301 | 5/1994 |
| JP | 2003-262201 | 9/2003 |
| WO | WO 97/46823 | 12/1997 |
| WO | WO 01/55602 | 8/2001 |

* cited by examiner

PRESSURE ACCUMULATOR, ESPECIALLY PULSATION DAMPER

FIELD OF THE INVENTION

The present invention relates to a pressure accumulator, especially a pulsation damper having a pressure accumulator housing and a piston part located therein. A bellows-shaped separating element is supported with its one end on the piston part and with its other end on the pressure accumulator housing. The separating element separates two working chambers from each other, especially a gas space from a fluid space within the pressure accumulator housing, in a fluid-tight, especially gastight, manner.

BACKGROUND OF THE INVENTION

In the prior art (e.g., WO 01/55602 A1) hydropneumatic pressure accumulators are known, with a bellows separating a gas space from an oil space within the pressure accumulator housing. The bellows, especially in the form of a metal bellows, is attached on its one end to the pressure accumulator housing, such that the oil space borders the inside of the bellows. On its other free end, the bellows is sealed by a closure body which can be moved according to volume changes of the gas space and oil space as the two working chambers of the pressure accumulator. A valve blocks or releases the flow of the hydraulic fluid out of and into the oil space. The movement of a closure body corresponding to an increase in the volume of the gas space exceeding a given maximum value moves the closure body into its blocking position. The closure body is made in the form of a trough with a bottom designed as a movable valve member of the valve to control the flow of the hydraulic fluid medium.

As is recognized, in bellows-type pressure accumulators with rubber bellows or metal bellows, care must be taken that overloading of the bellows be avoided. In another known pressure accumulator (WO 97/46823 A1), with respect to this problem a valve stem of the valve connected to the oil space is configured relative to the closure body of the metal bellows in a positional relationship such that the closure body of the metal bellows made as a flat end plate acts on the valve stem when a desired end position is reached and moves it into the blocking position of the valve. The outflow of the hydraulic fluid from the oil space is then stopped when this end position of the end plate of the metal bellows is reached. With the valve closed, even when the connected hydraulic system should become unpressurized, a pressure is maintained in the oil space of the pressure accumulator corresponding to the gas pressure prevailing at the time in the gas space so that a pressure equilibrium prevails on the metal bellows on either side.

This arrangement prevents overloading of the bellows when in operation of the pressure accumulator the pressure of the hydraulic system connected on the oil side decreases. However, there is the danger of damage to the bellows in states with an overpressure prevailing on the oil side or in the absence of the prefill pressure on the gas side. Since in this known pressure accumulator the maximum value of the volume of the gas space corresponds essentially to the stroke volume defined by the motion of the end plate taking place when the metal bellows contracts and expands, the stroke length which the end plate can traverse within the pressure accumulator housing must be selected to be relatively long if a gas space volume sufficient for pressure accumulator operation is to be made available. In the absence of a gas prefill pressure or overpressure prevailing on the oil side, the prevailing pressure gradient acts on the fully extended and thus mechanically most heavily loaded metal bellows. It is therefore necessary to use either thicker or multilayer metal bellows. Disadvantageously for this reason the spring stiffness is greatly increased. This increased spring stiffness leads to a comparatively poor response behavior in operation. Multilayer bellows lead to increased weight and higher costs. Moreover the stroke per turn of the bellows is less.

In WO 01/55602 A1, a valve stem is attached to the trough bottom, extends concentrically to the longitudinal axis out of the pressure accumulator housing, and is connected to a second movable valve element. When the motion of the trough exceeds a given minimum value of the volume of the gas space, the valve stem interacts with a second valve seat to block the flow of the hydraulic fluid into the oil space. The advantageous possibility then arises of controlling the end position of the trough corresponding to the minimum value of the volume of the gas space using an oil-side valve. Since in the known solution the entire interior of the trough is available as part of the gas space, an optimum ratio is achieved between the total size of the pressure accumulator housing and the volume of the gas space, although the volume to be assigned to the gas space for accommodation and management, especially in the form of pulsation damping for the hydraulic fluid as a further fluid, cannot then be available. In the known solution, the pressure accumulator housing can be shaped such that it forms a mechanical stop after short stroke motion of the trough, because the entire interior of the trough is available as a gas space volume. The metal bellows as a whole is protected not only against overly strong expansion, but since it surrounds the outside of the indicated trough, the bellows at the overpressure prevailing in the gas space is also mechanically supported on the outside of the trough over the entire length. In spite of this circumstance and in spite of the existing very small "dead volume" between the trough and bellows, it however cannot be precluded that individual folds of the metal bellows are still unduly exposed to stresses and can tear and fail. Furthermore, both in the area of the valve element and in the area of the possible trigger point between the trough which can move lengthwise and the inside wall of the pressure accumulator housing, seals are necessary which are fundamentally subject to wear and consequently can lead to failure of the known hydropneumatic pressure accumulator solution.

SUMMARY OF THE INVENTION

An object of the present invention is to provide an improved pressure accumulator while maintaining the prior advantages, such that in a very small installation space a large measure of damping is achieved with respect to the pulsations of a hydraulic fluid including fuel such as diesel fuel as another fluid in the fluid space of the pressure accumulator, with simultaneous implementation of effective protection for each individual fold or deflection of the bellows to ensure reliable operation even over very long cycle times with a plurality of changing load cycles.

This object is basically achieved by a pressure accumulator where the gas working chamber is filled with a liquid in addition to a definable volumetric portion of a working gas. Up to a definable degree the working gas allows compression. In this way, damping and smoothing of the pulsations of the pertinent fluid medium occur on the fluid side of the pressure accumulator.

By adding a liquid to the side of one working chamber of the pressure accumulator with the working gas, the gas space formed in this way is reduced accordingly in volume by the fluid filling. Decoupling from the working gas to the fluid can take place such that the fluid as a damping support medium enters between the folds and deflections of the bellows-shaped separating element on its inside. In the expansion and contraction processes of the bellows in operation of the pressure accumulator, the pertinent folded wall parts of the bellows can then be supported on the fluid as an opposing support. This arrangement leads to a detectable increase of the service life of the pressure accumulator of the present invention and consequently to an increase in its operating reliability. The increased operating reliability applies especially for rapid pulsations and high-speed pressure surges. Depending on the position of the piston part assumed at the time and the position of the bellows-shaped connecting element is connected in this respect, the fluid can be displaced with the other working gas into the working chamber or can be recovered from there back into the intermediate spaces between the folds for support processes.

Preferably, a fluid is used which can flow very quickly as a thin-liquid medium within the working chamber with the working gas. Furthermore, the fluid must be suitable in the area of the design temperature for the pressure accumulator to perform its intended task, for example from −10° C. to +160° C. It has proven advantageous to use a fluid charge with which it is ensured that little working gas within the fluid goes into solution in order in this way to not unnecessarily reduce the effective volumetric portion of working gas for damping of pressure surges. A combination of nitrogen gas as the working gas and ethylene alcohol as the fluid on the gas side of the pressure accumulator as a fluid charge has proven especially advantageous. Preferably, the volumetric portions of the working gas and fluid are chosen to be the same or there is preferably slightly more fluid than working gas in the respective working chamber of the pressure accumulator. In different exemplary embodiments, it is also possible to choose the spaces and/or charging amounts differently in terms of their magnitude. Advantageously however it must be watched that the gas space is essentially filled with fluid shortly before the maximum spring path has been reached.

Another advantage in this solution is that the piston side on the actual fluid side of the pressure accumulator can be provided with a cavity which can be filled with additional fluid. On the fluid side of the pressure accumulator, the accommodation capacity for the hydraulic fluid including fuels is then increased to improve the effectiveness of the pressure accumulator for pulsation damping. In this way, a different approach is taken compared to the known solutions in which the attempt is made to improve the working capacity of the pressure accumulator such that the intended cavity of the piston part has been placed on the side of the working chamber with the working gas (cf. WO 01/55602 A1). It is surprising to one with average skill in the art of pressure accumulators that by reversing this action principle with a reduced gas proportion and with simultaneous filling with a fluid on the gas side of the pressure accumulator improved damping values for the fluid penetrating into the pressure accumulator occur, attaining increased operating reliability at the same time. Since the pertinent pressure accumulator solution for the movable parts manages without additional seals, the prerequisite for continuous operation free of wear is also present.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
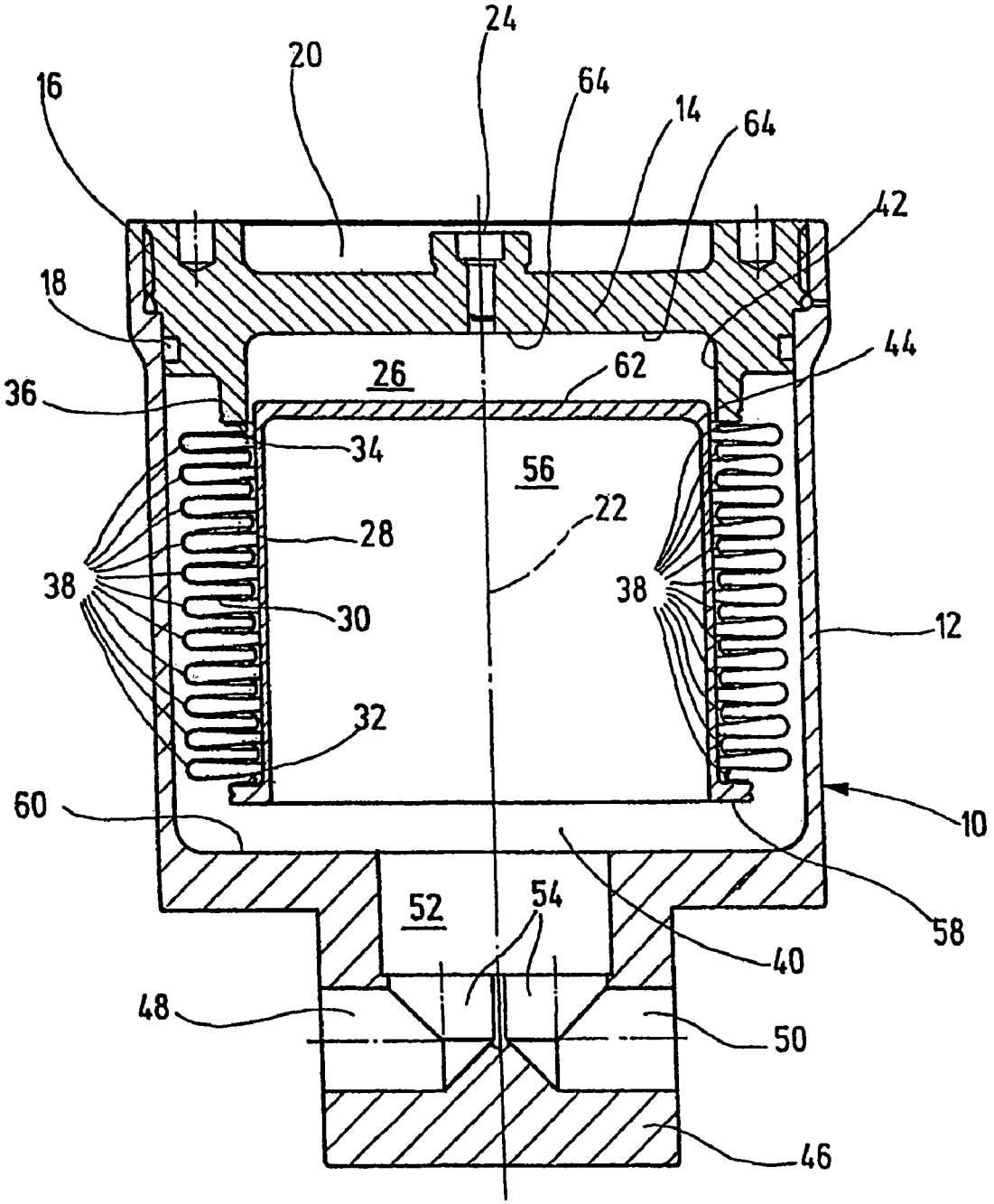
FIG. 1 is a side elevational view in section of a pressure accumulator with a metal bellows according to an exemplary embodiment of the present invention.

The illustrated exemplary embodiment of a pressure accumulator is intended especially for use in fuel and heavy oil systems to damp and smooth pressure surges of the operating medium. In the area of fuels, especially diesel fuel or the like is meant. The pressure accumulator could also be used in electrohydraulic braking systems, for example in vehicle construction. The illustrated pressure accumulator has a pressure accumulator housing 10, with an essentially circularly cylindrical, pot-like main part 12. The main part 12, viewed in the direction of the FIGURE, at the top has a cover part 14 connected to the pot-like main part 12 via a threaded section 16. The interior of the pressure accumulator housing 10 is sealed against the environment by a sealing means or seal in the form of a gasket 18. For reasons of weight reduction, the cover part 14 can be provided with a material recess 20. Along the longitudinal axis 22 of the pressure accumulator, the cover part 14 is penetrated by a sealing screw 24. After removal of sealing screw 24, the working gas, for example in the form of nitrogen gas and/or a fluid, for example in the form of ethylene glycol, is allowed to flow by a suitable device (not shown) into the working chamber 26 of the pressure accumulator. Working chamber 26 is conventionally also referred to as the gas space in conventional pressure accumulators.

A piston part 28 present within the pressure accumulator housing 10 is configured to be able to move axially along the longitudinal axis 22 of the pressure accumulator. A bellows-shaped separating element 30 extends along the outer peripheral side of the piston part 28, and is supported with its one end 32 on the piston part 28 and with its other end 34 on an annular extension 36 of the cover part 14 which projects down. The separating element 30 is preferably designed as a metal bellows, with a plurality of annular individual folds 38 or deflections which extend over the cylindrical piston part 28 on the outer peripheral side with a definable distance in a zig-zag shape in the form of pleats. The piston part 28 also separates, in a fluid-tight manner, one working chamber 26 referred to as the gas space 26 from another, second working chamber 40 referred to as the fluid space in these pressure accumulators.

The annular extension 36 of the cover part 14 is to be regarded as a component of the pressure accumulator housing 10. On its inside, extension 36 has a cylindrical guide surface 42 within which the top end of the piston part 28 is guided to be able to move lengthwise, while maintaining a radial distance in the form of an annular gap 44. The pressure accumulator housing 10, viewed in the direction of the FIGURE, on its bottom has a cylindrical pipe union 46, with two fluid connections 48, 50 discharging into a common antechamber 52 within the pipe union 46. The two fluid connections 48, 50 extend at right angles to the longitudinal axis 22 of the pressure accumulator in entering the pipe union 46 and emerging from pipe union 46. For purposes of optimized flow guidance, it has proven effective if fluid guidance is undertaken in this way by deflection points 54 extending at a right angle thereto and perpendicular to the respective alignment of the fluid connections 48, 50. It is sufficient for operation of the pressure accumulator if there is fluid over the antechamber 52 in the other working chamber 40, and fluid passage is not absolutely necessary. Even with the fluid column stationary, pulsations and pressure surges occurring can be accordingly smoothed and damped. Furthermore, it is advantageous if the fluid connections 48, 50 in the pipe union 46 enter and exit at the same height and discharge jointly over this same path into the antechamber 52, due to the identically acting deflection points 54.

To increase the volume of the fluid space on the side of the other working chamber 40 of the pressure accumulator, the piston part 28 has a cylindrical cavity 56 which, except for a reduced wall thickness for the piston part 28, essentially fills it. In the area of the connection between the bellows-shaped separating element 30 to the piston part 28 on its one end 32, the piston part 28 has an annularly widening stop 58 for striking the assigned adjacent inside wall 60 of the pressure accumulator housing 10 into which the antechamber 52 of the pipe union 46 discharges. The piston part 28, on its end opposite the stop 58, is provided with a stop surface 62 running transversely to the longitudinal axis 22 of the pressure accumulator used to strike the other, opposite inside wall 64 of the pressure accumulator housing 10, preferably formed by the cover part 14. With stop surfaces formed in this way, an overload protection is ensured helping prevent squeezing together or overwidening which damages the metal bellows by pulling apart.

By the annular gap 44, it is possible that partial fluid filling occurs in the working chamber 26 between the formed cavities of the individual folds 38 and the outer periphery of the piston part 28. In this way, movements of the individual folds 33 are supported accordingly. In a compression process in which two adjacent walls of an individual fold 38 move toward each other, the fluid accommodated in this way is forced back in the direction of the working chamber 26. Viewed in the direction of the FIGURE, when flow from the pertinent initial state of the piston part 28 travels up in the direction of the inside wall 64, and for the opposite motion of the piston part 28 and when the folds 38 are pulled apart, the corresponding liquid volume can flow after from the working chamber 26 via the annular gap 44 into the intermediate spaces between the folds 38, if the pertinent intermediate spaces are connected to the annular gap 44 and the working chamber 26 to carry fluid.

This working chamber 26 is filled with a working gas, for example, nitrogen gas, which in this respect for purposes of smoothing or damping accommodates pressure surges delivered on the fluid side 40 of the pressure accumulator into the latter. Possible heating in the area of the metal bellows as a bellows-shaped separating element 30 can be likewise easily managed with the liquid delivered in the working chamber 26, especially in the form of ethylene glycol. Ethylene glycol, otherwise as a thin liquid medium, has good inflow and outflow behavior and furthermore dissolves as the working gas is necessary for the damping behavior of the pressure accumulator. Use for rubber bellows as a bellows-shaped separating element 30 is likewise meant.

While one embodiment has been chosen to illustrate the invention, it will be understood by those skilled in the art that various changes and modifications can be made therein without departing from the scope of the invention as defined in the appended claims.

What is claimed is:

1. A pressure accumulator for dampening pulses, comprising:

an accumulator housing having a gas space and a fluid space therein and having opposite first and second inside walls, said second inside wall having an annular extension with a cylindrical guide surface inside said housing;

a piston part located and movable in said housing, having a stop at one end thereof engageable with and adjacent to said first inside wall of said housing and having a stop surface on an opposite end thereof engageable with said second inside wall of said housing, said opposite end of said piston part movable along a longitudinal axis thereof within said guide surface maintaining a radial distance and forming an annular gap therebetween;

a bellows-shaped separating element supported at one end thereof on said piston part adjacent said stop and at an opposite end thereof on said housing and separating said gas space and said fluid space in said housing with said piston part in a fluid-tight manner, said separating element extending along an outer peripheral side of said piston part from said annular extension to said one end of said piston part; and a definable volumetric portion of a working gas and a liquid fill said gas space, said liquid being an alcohol.

2. A pressure accumulator according to claim 1 wherein said alcohol is ethylene glycol.

3. A pressure accumulator according to claim 2 wherein said housing comprises fluid connections connected to and supplying fluid pressure to said fluid space in said housing.

4. A pressure accumulator according to claim 3 wherein said faces said fluid connections.

5. A pressure accumulator according to claim 3 wherein said fluid connections extend in a pipe union of said housing and discharge into a common antechamber within said pipe union.

6. A pressure accumulator according to claim 3 wherein said fluid connections supply one of diesel fuel and heavy oil to said fluid space.

7. A pressure accumulator according to claim 6 wherein said piston part comprises a cavity facing said fluid space holding additional fluid.

8. A pressure accumulator according to claim 1 wherein said second inside wall of said housing is on a cover part of said housing.

9. A pressure accumulator according to claim 1 wherein said separating element is a metal bellows with a plurality of individual folds located on top of one another.

10. A pressure accumulator according to claim 1 wherein said annular gap conveys said working gas and said liquid to flow to an inside of said separating element.

11. A pressure accumulator according to claim 1 wherein said piston part comprises a cylindrical wall extending between said stop and said stop surface and extending along an inner surface of said separating element.

* * * * *